United States Patent [19]

Ferguson

[11] Patent Number: 4,911,001

[45] Date of Patent: Mar. 27, 1990

[54] CORE SURFACE WASHER

[75] Inventor: William S. Ferguson, Tulsa, Okla.

[73] Assignee: Amoco Corporation, Chicago, Ill.

[21] Appl. No.: 265,086

[22] Filed: Oct. 31, 1988

[51] Int. Cl.[4] ..... E21B 49/00

[52] U.S. Cl. ..... 73/153

[58] Field of Search ..... 73/151, 153, 863; 125/12, 35; 134/137, 144, 151, 30, 115 R; 175/208; 250/255; 324/376, 377

[56] References Cited

U.S. PATENT DOCUMENTS 2,617,719 11/1952 Stewart ..... 23/312
3,025,398 3/1962 Dameron ..... 250/255
3,373,440 3/1968 Jenkins et al. ..... 73/153

OTHER PUBLICATIONS

Swayne, R. E., "Continuous Wireline Core Drilling . . . ", Drill Bits, Sprint 1988.

*Primary Examiner*—Stewart J. Levy
*Assistant Examiner*—Kevin D. O'Shea

[57] ABSTRACT

Drilling muds and particulate matter are removed from the surface of core produced from a wellbore while maintaining naturally occurring fluids in the core substantially as existing at the time of removal from the wellbore.

13 Claims, 6 Drawing Sheets

CORE SURFACE WASHER

FIELD OF THE INVENTION

The invention relates to cleaning the surface of cores removed from wellbores prior to analysis. In a particular aspect, the invention relates to cleaning large quantities of core as such core is being produced at the well site and maintaining the in-situ fluids substantially unaffected.

Setting of the Invention

Stratigraphic exploration wells can be drilled in which core is taken along substantially the entire depth of penetration. See Swayne, "Continuous Wireline Core Drilling," Drill Bits, p. 7–12 (1988). Instrumental analysis of such core at the well site, while in-situ fluids are substantially unchanged from conditions in the subsurface and while the core itself is fresh and has not lost transient color and structure information, can be of significant value to the explorationist.

Certain aspects of evaluation require that fresh core be processed promptly after being removed from the wellbore and that the core surface be clean of drilling muds and particulate matter.

One example is photographing or producing a video color record of the surface of the core while the transient color and structure, for example, of certain shaly or rubbly zones which are substantially lost after the core is exposed to drying, decompressional and oxidizing conditions, are still substantially present and intact. Another example is scanning the surface of the core using infrared and/or ultraviolet spectroscopy to produce data indicative of hydrocarbons.

Other aspects of evaluation require that the in-situ fluids of the core not be significantly affected before evaluation. Such evaluations include, for example, ultraviolet scanning of the surface of the core for recognition of hydrocarbon-bearing zones.

It will be appreciated that analysis of the core while hydrocarbons are continuing to exude from formation sampled by the core is critical and therefore that washing procedure is desirably adapted for field processing large quantities of core in a timely manner without significantly altering or causing depletion of naturally-occurring fluids.

Other problems to be addressed are the need to position securely a horizontal cylinder of rocks, typically reassembled from pieces of freshly drilled continuous core with all broken ends refitted closely together to retain the spatial relationships such as depth, order, linear footage, and axial orientation for each batch of core handled through all subsequent processing until the core is uniquely labeled and marked to document these relationships.

Since batches of the continuous core can be 20 or more feet long and can be comprised typically of from 8–100 pieces and can weigh for the largest core diameter up to 200 lbs in the aggregate, at one step in the processing the core is desirably cut into standard shorter length joints for efficient analysis and material handling downstream such as palleting, storage, shipping, and the like. Further, the assembled core must be moved efficiently into position at several different stationary processing facilities where each needed core preparation step can be achieved without disturbing the reassembled core.

SUMMARY OF THE INVENTION

In accordance with the invention, there is provided a core washer system for removing from the surface of freshly produced core drilling mud and other particulate matter in preparation for instrumental and other analysis of the core, particularly for analysis of transient characteristics of the core surface.

In accordance with the invention, there is provided apparatus for preparing core removed from a wellbore for analysis comprising a carriage for supporting the core; conveyor means for supporting the carriage and for moving the carriage supporting core; and washing means for contacting the surface of the core as it is moved by the conveyor means supported on the carriage with a stream of washing fluid at a velocity and for a period of time effective for removing drilling mud and unattached particulate matter from the surface of the core while maintaining in-situ fluids substantially unaffected.

According to further aspects, the invention further comprises cutting means for cutting washed core supported by the carriage into sections. According to a further aspect, the carriage for supporting the core comprises means for supporting the core leaving the greater part of the surface exposed to washer means, the carriage means being effective for supporting the core in an orientation in which the core is placed on the carriage means; and the carriage means further having spaced-apart kerfs for allowing completely cutting through the core without removing the core from the carriage.

According to further aspects, the conveyor means comprises a frame having rollers spaced apart thereon for supporting the carriage and further having motors spaced apart for driving at least one of the rollers and for driving the carriage along the frame, the carriage being self-disengaging from the at least one driven roller after passing; the washing means comprises at least one array of spray nozzles positioned to contact exposed surface of the core and to remove drilling muds and particulate matter from the surface; and the motors driving the carriage supporting the core through the washing means at a rate effective for permitting removing drilling mud and particulate matter from the surface and for retaining in-situ fluids in the core substantially intact.

According to further aspects, the invention comprises a housing for enclosing washing means and drying means and the conveyor means for supporting the carriage and moving the core passing through the housing, the washing means and drying means being spaced adjacent the conveyor means within the housing, the housing further comprising one or more settling compartments for allowing sediments comprising drilling mud and particulate matter present in the fluids removed from the core to settle and the fluid to be recirculated to the washing means for reuse; the housing further comprising a drain for delivering fluids containing sediments removed from the core to the settling compartment; the drying means comprising an array of air nozzles for delivering a stream of compressed air to the surface of the washed core and for driving the fluids on the surface of the core in the direction of the drain.

According to a further aspect, the washing means comprises at least two arrays of spray nozzles positioned to contact exposed surface of the core supported on the carriage as it is conveyed by the conveyor means, a first array having a higher pressure delivery of washing fluid than a second array, or than both used together.

BRIEF DESCRIPTION OF THE DRAWINGS

The invention will be further understood and appreciated from the following description and from the drawings.

DETAILED DESCRIPTION OF THE INVENTION

Figure 1:
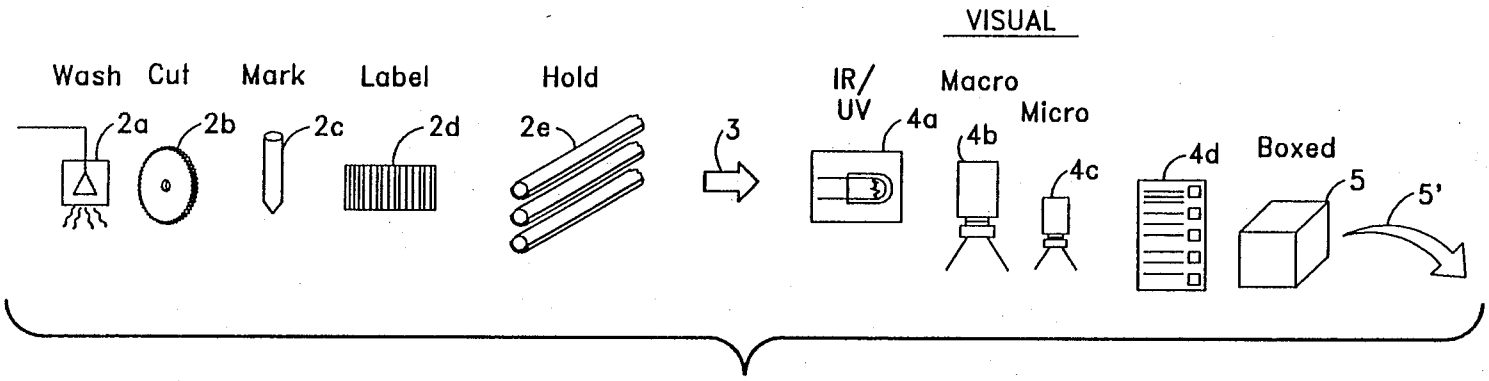
FIG. 1 illustrates schematically an analysis of transient characteristics of fresh whole core using the core surface washer.

Referring now to FIG. 1, FIG. 1 illustrates an application illustrated by dashed line 1 of cleaning the surface of fresh whole core in the context of field analysis of transient characteristics of such core.

As illustrated in, FIG. 1, after the fresh core is surface washed 2*a* and cut 2*b* and marked 2*c* with an orientation indicator such as a direction indicating stripe, it can be labeled 2*d* and held at a temporary holding station 2*e* showing a plurality of cores in standard increments for subsequent analysis. Thereafter as indicated by arrow 3 core can be provided to transient characteristic analysis in which, infrared absorption/reflectance spectroscopy (IR) 4*a* to provide indication of mineralogy, ultraviolet fluorescence/absorption spectroscopy (UV) to determine the presence of hydrocarbons in formations, preparation of a video or photographic record (VISUAL) which can be either or both on the macro 4*b* and microscale (MICRO4*c*, and the geological description 4*d* of the fresh core can readily proceed. Thereafter, all or preferably selected portions of the core can, for example, be boxed 5 and shipped to a remote facility indicated by arrow 5' for further analysis. While the invention is described in the context of a preferred embodiment in which the core surface washer is used for cleaning whole core for field analysis of fresh core where the in-situ fluids must be substantially unaffected, the invention can also be applied in other core analysis contexts. Prior to this invention, core has been washed by hand, for example, using brush and water. However, such is not efficient to field analysis of core when substantially all of the core from surface to total depth must be cleaned.

It has been discovered that fresh core is readily washed in accordance with the invention and that neither mechanical means such as brushes are required nor in most cases even surfactants. In fact, it has been found that surfactants and solvents are not necessary for cleaning the core even when oil-based muds are used during drilling. As a result, minimal alteration of in-situ fluids can be achieved. In drilling through subsurface formations having heavy oils and tars associated, use of surfactants and solvents may be advantageous. Thus, the washing fluid is preferably water although surfactants and antifoaming agents can be used. Solvents and surfactants are preferably not used when the goal is surface washing since it is desired to modify in-situ fluids as little as feasibly consistent with cleaning the surface of the core. For example, in regard to UV spectroscopy, it has been found that fresh core washed in a core washer using water as a washing fluid continues to exude hydrocarbon from hydrocarbon bearing formations after washing providing a strong indication during UV analysis. Hydrocarbons, however, have been found to be substantially unavailable at the surface of cores in as little as 72 hours. Hence there is a strong need for core surface washing which minimally affects in-situ fluids and for prompt preferably well-site analysis.

Figure 2B:
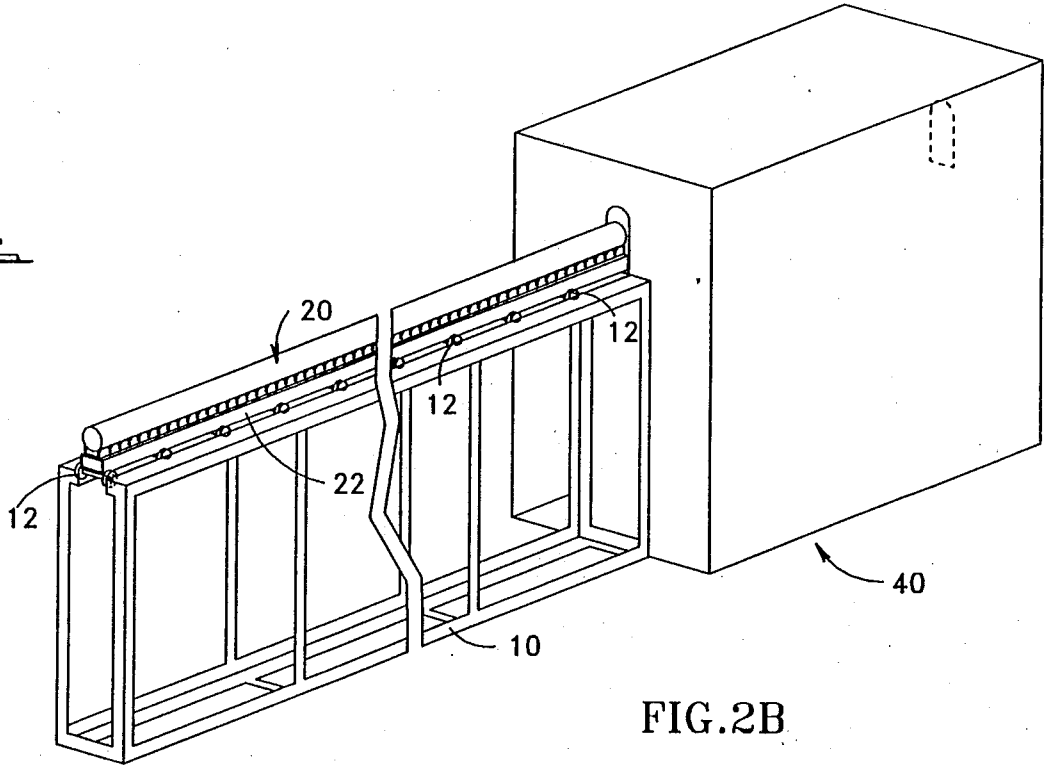
FIG. 2B schematically the core carriage and the core conveyor system upstream of the core surface washer.
Figure 2A:
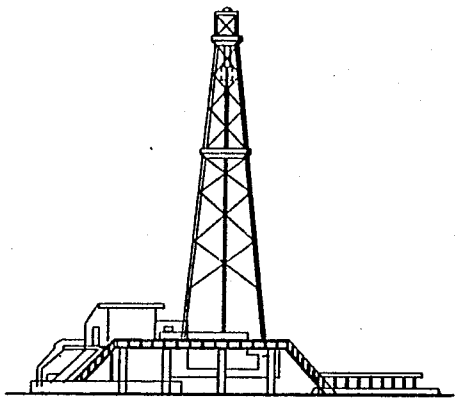
FIG. 2A illustrates a whole core drilling operation.
Figure 5:
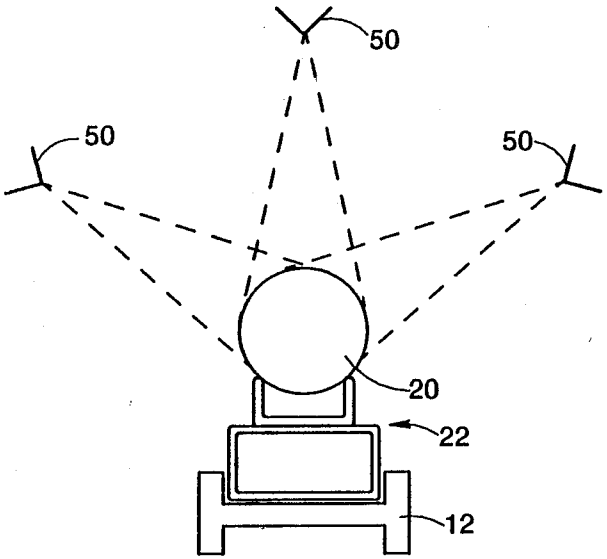
FIG. 5 illustrates an array of washer nozzles in the core surface washer.

Referring now to FIG. 2A, FIG. 2A, shows a core carriage and conveyor system in accordance with the invention upstream of the core surface washer 40. As illustrated, core can be taken from a whole core drilling operation as illustrated in FIG. 2A and transported (arrows 6) in the core barrel 7 by persons 8 to a core conveyor as illustrated in FIG. 2B. At the core conveyor as illustrated in FIG. 2B, the core is removed from the core barrel 7 and the core 20 is reassembled on carriage 22 so that the pieces of the core, which can range typically from 8 to 100 pieces, are arranged to the extent possible in the in-situ subsurface orientation for further processing. Carriage 22 can then be delivered by gravity feed rollers 12 specially adapted for carriage 22 and supported by rack 10 into core surface washer 40. Rollers 12 can be of any suitable design; preferably the rollers are dumbbell-shaped as shown in FIG. 5 and support carriage 22 on the middle small diameter portion between outer larger diameter portions.

Figure 3:
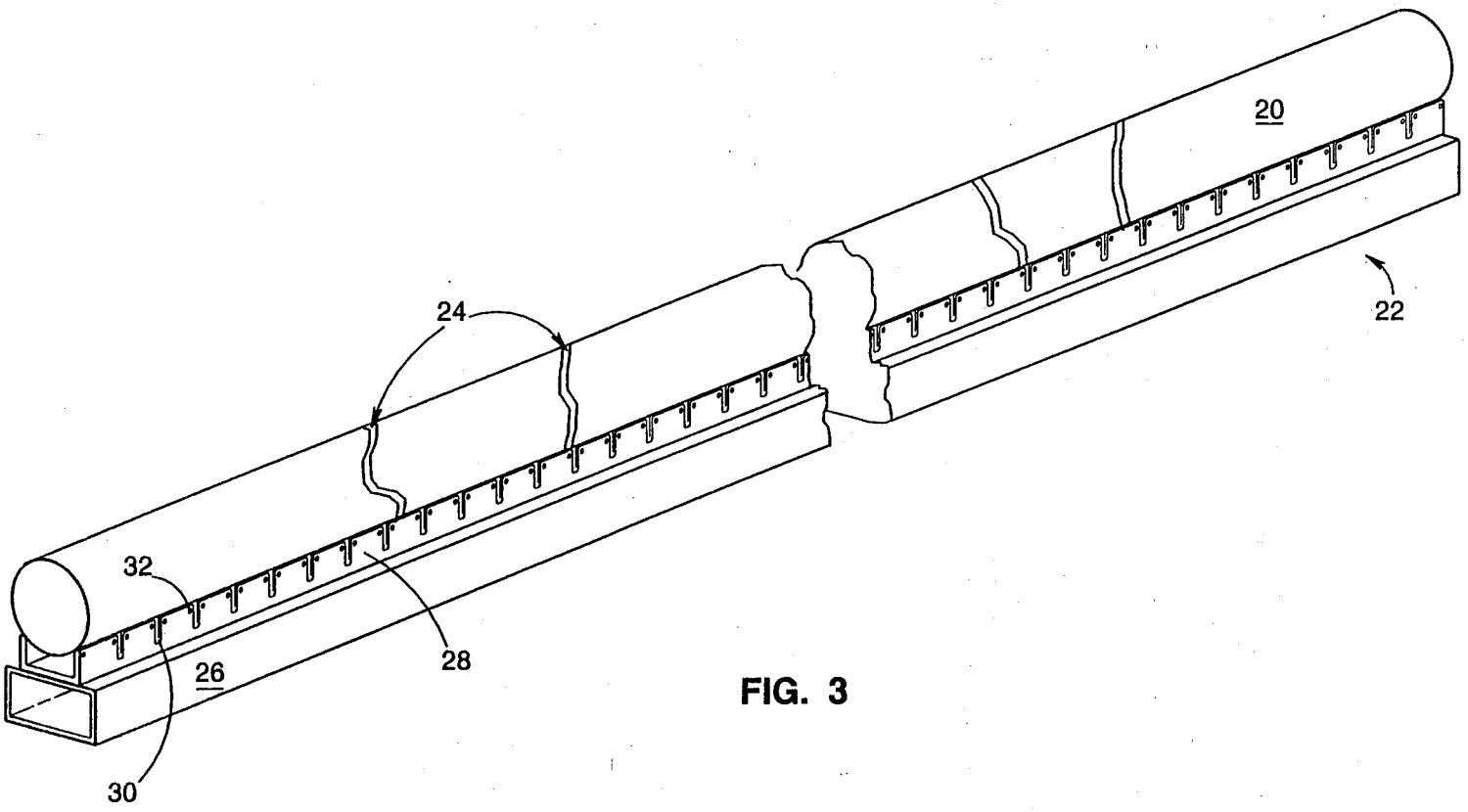
FIG. 3 illustrates schematically a carriage for conveying core through the core surface washer.

Referring now to FIG. 3, FIG. 3 illustrates in more detail a preferred embodiment of carriage 22 supporting a section of core 20. As illustrated, carriage 22 can comprise a long rigid bar 26 suitable for maintaining the core in substantially unaltered orientation during its processing. Carriage 22 can comprise, for example, a rectangular, rigid bar such as bar 26 made of, for example, rectangular, tubular aluminum having the lower surface roughened, for example, by sand blasting to provide good engagement with frictional drive means. The upper surface can also be roughened to reduce bowing of the core carriage 22.

Bowing of the core carriage can result in the carriage not being conveyed evenly, stopping due to lack of contact with the frictional drive, and the like due to asymmetrical expansion of the carriage. The problems due to bowing of carriage 22 can be further appreciated by considering that the length of core can be 20 feet or more.

Bowing and warping of the core carriage can result from asymmetric mechanical or thermal expansion of the carriage. For example, when roughening aluminum bar 26 by sandblasting, it was found that the resulting redistribution of metal caused bowing of the bar. Accordingly, sandblasting is preferably conducted equally on opposite surfaces of the bar, preferably in stages, to prevent bowing of the bar.

Asymmetric thermal expansion can also occur. The carriage can be exposed in the heat or cold and differential heating or cooling can occur, followed by passing through the core surface washer into a temperature controlled space for cutting and analysis of the core. Bowing and warping caused by thermal expansion can be controlled by using the same materials of construction for all of carriage 22 including, for example, using preferably mechanical connectors rather than welding or braising.

As illustrated, the core is further supported by a trough 28 such as rectangular channel aluminum on bar 26. Trough 28 can have kerfs 30 cut at spaced intervals along the side. Trough 28 can be, for example, rectangular, triangular, semi-circular and the like, and can be mounted to bar 26 by welding or braising, preferably by riveting, bolting, and the like, or can be of integral construction with bar 26. Kerfs 30 are provided at regular intervals to permit cutting of core 20 without removal of the core from the core carriage 22. Adjacent each of the kerfs can be holes 32 passing therethrough for strapping broken core (see cracks 24) adjacent the kerfs where cuts will be made to ensure that cuts are efficiently and accurately made without altering orientation of the core as it has been reassembled on carriage 22. Strapping can also be used to maintain orientation of core during core preparation generally. See straps 68 in FIG. 7A.

Figure 4:
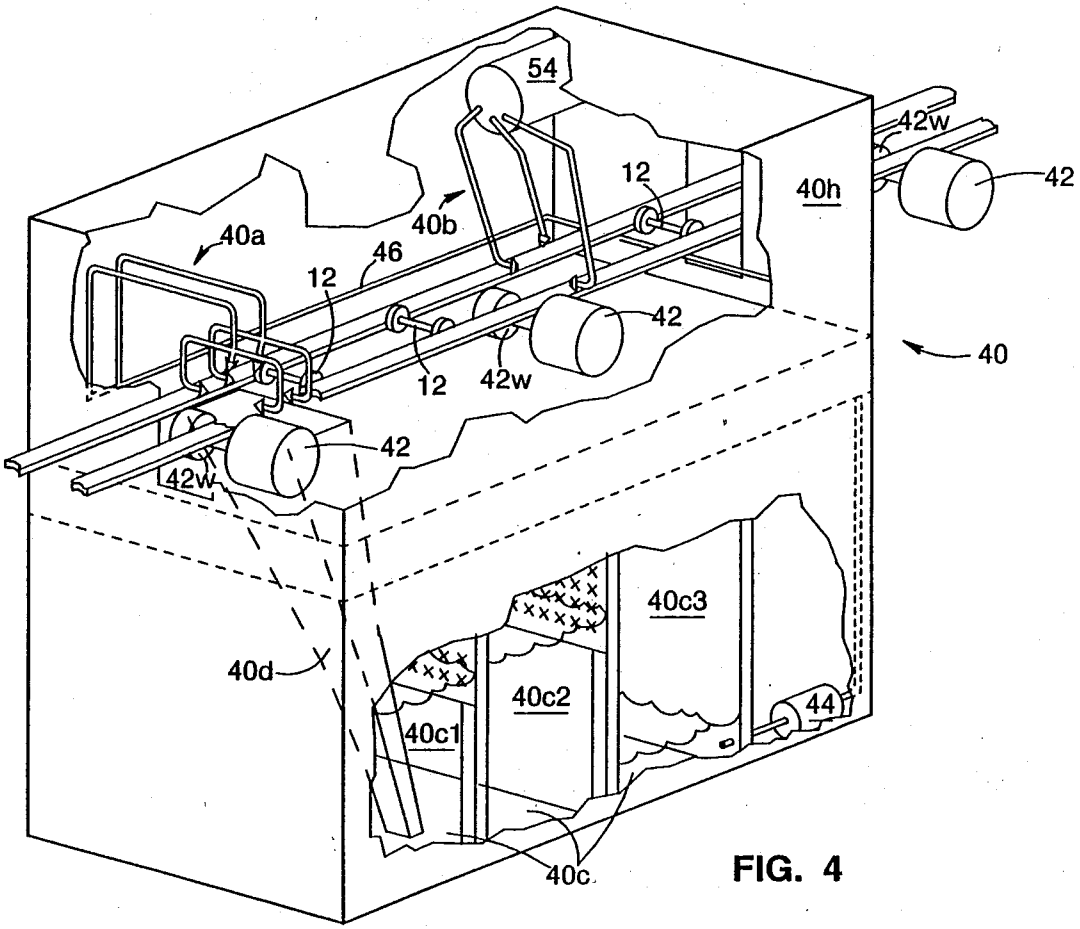
FIG. 4 illustrates a core surface washer.

Referring now to FIG. 4, FIG. 4 illustrates a core surface washer 40 in accordance with the invention. Core surface washer 40 comprises a housing **40*h*, one or more core surface washing arrays 40*a*, a core surface drying array 40*b*, and a washing fluid storage and recirculation system 40*c***.

As illustrated in FIG. 4, after carriage 22 carrying core 20 is provided to the core surface washer 40, motor 42 having drive wheel **42*w*, for example, for frictionally engaging the lower surface of the bar 26 of the core carriage 22**, controls progress of the core through the washer.

The washing station **40*a*** can consist of one or more, two in the illustrated embodiment, arrays of nozzles for core surface washing for directing high velocity jets of cleaning fluid, preferably water, at the exposed surface of the core.

Nozzles 50 of the core washer are preferably disposed as illustrated in FIG. 5 to provide a high velocity stream to contact all of the exposed surface of core 20. In addition to contacting all of the exposed surface of the core, the nozzles must be positioned so that balanced forces are exerted on the core at least to the extent that the core is not caused to be driven by water pressure from carriage 22.

In addition to the criticality of balanced forces being exerted on core 20, there is a further criticality of distance of the nozzle from the core. This criticality arises from the need to clean the surface of the core and to remove loosened particulate matter therefrom, but not to dislodge particles from the core matrix. Positioning high pressure nozzles preferably capable of delivering a high velocity sheet or spray of water at 200 to 500 psia at a distance from the core of 3 to 4 inches is preferred. The result is a core surface where all grains are an integral part of the core surface. As indicated herein, where softer shales or rocks such as certain rubbly zones are processed a lower velocity spray can be advantageously used to avoid damage to the core.

By the use of two or more core washer arrays **40*a***, different pressures for washing respectively greater and lesser structurally strong portions of the core can be provided and switching from one system to the other can be effected by valves. For example, a first system for high pressure washing of solid, high strength core such as most limestones, sandstones, and the like, and a second lower pressure system for washing cores having a lower structural strength (such as certain shales, rubbly zones, and the like) can be provided.

Referring again to FIG. 4, motor 42 drives carriage 22 carrying core 20 along the gravity feed rollers 12 and a pump 44 receives washing fluid, for example, water, from storage **40*c*, and provides it through a nozzle supply 46 to the washing stations 40*a***.

The fluid from the washing station can be drained by drain **40*d* into a baffled series of compartments 40*c*1, 40*c*2 and 40*c*3 for sediment removal. Preferably the drain extends below the surface of the water to deliver the sediments adjacent the bottom of storage 40*c* to prevent unnecessary rolling of sediments in the first settling compartment 40*c*1 where the major accumulation of solids will occur. It will be appreciated as mud, particulate matter, and the like are washed from the surface of the core that such materials are carried with the fluid into the drain to storage 40*c*1. The baffled storage compartments can be provided with, for example, screens as illustrated or other means for excluding sediment flow so that in each successive compartment the sediment is diminished, permitting recirculation of washing fluid relatively free of suspended sediment. Each compartment of 40*c*** can also be provided with a clean-out port (not shown).

In achieving the desired result of cleaned core with little or no alteration of in-situ fluids, residence time in the washing station is particularly important. Advantageous results have been obtained with a volume of washing fluid delivered at about 10 gallons/minute and the core is advanced through the washing station at a rate of about 10 ft/minute. At these rates, about one gallon of fluid is delivered in a contact zone of about 1 ft in about 6 seconds. Such rates have been used even for halite (salt) with excellent results. Preferably, the wash fluid delivery rate can range from 4–8 gal/minute and the rate of core movement can range from 8–12 ft/minute. As a result, core can be washed at a rate consistent with processing core as it is being produced from the wellbore even during the drilling of stratigraphic exploration wells.

Figure 6:
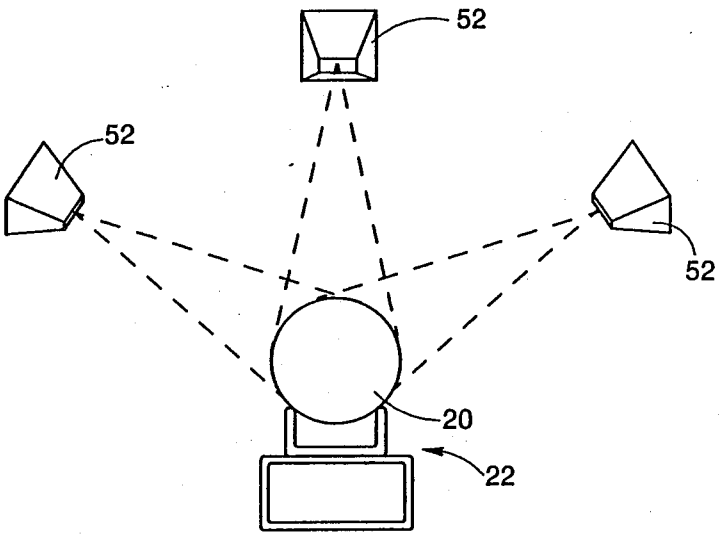
FIG. 6 illustrates an array of dryer nozzles in the core surface washer.

In the drying station **40*b*, nozzles 52 (see FIG. 6) are supplied air by compressor 54 (see FIG. 4) and positioned (see FIG. 6) to dry the exposed surface of the core by driving the water in the upstream direction toward the drain 40*d* (see FIG. 4). This produces an evenly dried surface of core when the core leaves the washer 40, for example, by carriage 22 being engaged by downstream motor 42**.

Figures 7A, 7B:
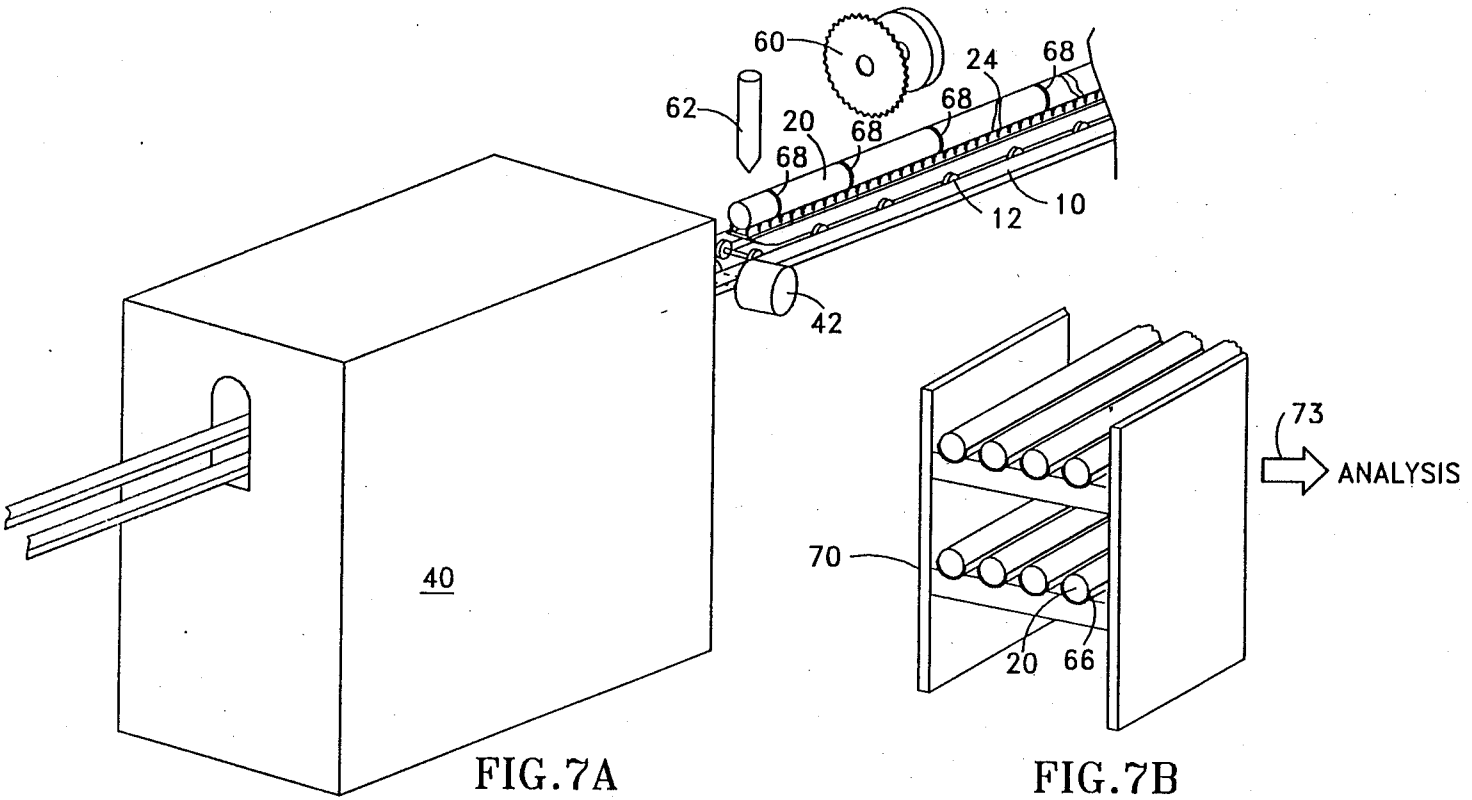
FIG. 7A illustrates schematically marking, sawing.
FIG. 7B illustrates storage downstream of the core surface washer.

Referring now to FIG. 7A, as core 20 leaves the core washer 40, it can be marked by ink jet printer 62 provide an orientation marker useful during subsequent processing. The ink jet printer can be used, for example, to print a series of arrows toward a selected end of the core, for example, the end having greater depth. Such a pattern preserves a record of the depth orientation of the core and provides an orientation line on the circumference of the core, permitting realignment of segments of the core even after cutting. The core 20 held down by straps 68 can be cut into sections by saw 60 transformed as indicated by arrow 9 and stored on conveyor troughs such as semi-circular 66 in a storage rack 70 (see FIG. 7B) preparatory to further analysis. Such further analysis can be as indicated above, infrared spectroscopy absorption/reflectance, ultraviolet absorption/reflectance, visual description and recording and the like. Other reference numbers used in FIGS. 7A and 7B. are described in the other FIGS. and need not be repeated here.

The invention will be further understood and appreciated from the following description of operation. From the description herein, it will be seen that core 20 can be placed and assembled on carriage 22, started by gravity feed into core washer 40 in which motors 42 take control of motion, washed, dried, cut, orientation marked by ink jet marker 62, and placed on semicircular troughs 66 in temporary holding rack 64.

In practice, however, it is found advantageous to provide the core to cutting station 60 where the core is cut into easily-handled lengths, for example, 3-ft lengths. Then the core is washed by reverse motion (right to left on the Figures) through the washing station, dried during forward motion (left to right on the Figures), orientation marked, bar code labeled (see FIG. 1), and placed in temporary holding. This procedure removes particulate matter deposited from the cutting along with the mud and other particulate materials derived from the core drilling operations.

The invention has been described in terms of a preferred embodiment. Those skilled in the art will be able to provide equivalents for the various aspects of the invention. Accordingly, the invention is not limited to the specific embodiments described herein, but by the claims appended hereto interpreted in accordance with applicable principles of law.

What is claimed is:

1. Apparatus for preparing core removed from a wellbore for analysis comprising:

a carriage for supporting the core;

means for supporting the carriage and for moving the carriage supporting core;

washing means for contacting the surface of the core as it is moved thereby supported on the carriage by the conveyor means with a stream of washing fluid at a velocity and for a time effective for removing drilling mud and unattached particulate matter from the surface of the core and for maintaining in-situ fluids substantially unaffected.

2. The Apparatus of claim 1 further comprising:

cutting means for cutting washed and dried core supported by the carriage into sections.

3. The Apparatus of claim 2 wherein:

the carriage for supporting the core comprises means for supporting the core leaving the greater part of the surface exposed to the washer means, the carriage means being effective for supporting the core in an orientation in which the core is placed on the carriage means, and the carriage means further having spaced apart kerfs for allowing the complete cutting through of the core without removing the core from the carriage.

4. The Apparatus of claim 3 wherein;

the means for supporting the carriage and moving the carriage supporting core comprises a frame having rollers spaced apart thereon for supporting the carriage and further having motors spaced apart thereon for driving at least one of the rollers and for driving the carriage along the frame, the drive means being self-disengaging from the at least one driven roller after passing thereby;

the washing means comprises at least one array of spray nozzles positioned to contact exposed surface of the core and to remove drilling mud and particulate matter from the surface thereof;

the motors driving the carriage supporting the core through the washing means at a rate effective for permitting removing drilling mud and particulate matter from the surface thereof and for retaining in-situ fluids in the core substantially intact.

5. The Apparatus of claim 3 further comprising:

drying means downstream of the washing means for driving fluid from the surface of the core after washing.

6. The Apparatus of claim 5 comprising:

a housing for enclosing the washing means and the drying means, the conveyor means for supporting the carriage and moving the core passing through the housing, the washing means and drying means being spaced apart adjacent the conveyor means within the housing, the housing further comprising one or more settling compartments for allowing sediments comprising drilling muds and particulate matter present in fluids removed from the core to settle and the washing fluid to be recirculated to the washing means, the housing further comprising a drain for delivering fluids containing sediments removed from the core to the settling compartment; and the drying means comprising an array of air nozzles for delivering a stream of compressed air to the surface of the washed core and for driving surface fluids in the direction of the drain.

7. The Apparatus of claim 6 wherein the carriage further comprises spaced-apart supports for strapping the core to the core carriage during passing through of the core.

8. The Apparatus of claim 7 wherein the spaced-apart supports are adjacent the spaced-apart kerfs so that strapped core is supported in its original orientation during cutting therethrough by cutting means.

9. The Apparatus of claim 8 wherein:

the washing means comprises at least two arrays of spray nozzles positioned to contact exposed surface of the core supported on the carriage, a first array having a higher pressure delivery of washing fluid than a second array.

10. The Apparatus of claim 5 comprising settling compartments in series for allowing sediments in the washing fluids to settle and washing fluid to be recirculated to the washing means.

11. Method for preparing core removed from a wellbore for analysis comprising:

placing the core on a carriage for supporting the core in substantially in the original in-situ orientation;

supporting the carriage and moving the carriage supporting core through a washing zone in which the surface of the core as it is moved therethrough supported on the carriage is contacted with a stream of washing fluid at a velocity and for a time effective for removing drilling mud and unattached particulate matter from the surface of the core and for maintaining in-situ fluids substantially unaffected.

12. The Method of claim 11 further comprising:

cutting washed core supported by the carriage into sections for subsequent analysis.

13. The Method of claim 12 wherein the carriage for supporting the core comprises means for supporting the core leaving the greater part of the surface exposed to the washer means, the carriage means being effective for supporting the core in an orientation in which the core is placed on the carriage means, and the carriage means further having spaced-apart kerfs for allowing complete cutting through of the core without removing the core from the carriage.

* * * * *